US008302258B2

(12) United States Patent
Lucci et al.

(10) Patent No.: US 8,302,258 B2
(45) Date of Patent: Nov. 6, 2012

(54) APPARATUS AND METHOD FOR CANCELING OPPOSING TORSIONAL FORCES IN A COMPOUND BALANCE

(75) Inventors: Robert M. Lucci, Rochester, NY (US); Wilbur James Kellum, III, Hilton, NY (US)

(73) Assignee: Caldwell Manufacturing Company North America, LLC, Rochester, NY (US)

( * ) Notice: Subject to any disclaimer, the term of this patent is extended or adjusted under 35 U.S.C. 154(b) by 0 days.

(21) Appl. No.: 13/437,289

(22) Filed: Apr. 2, 2012

(65) Prior Publication Data

US 2012/0186040 A1 Jul. 26, 2012

Related U.S. Application Data

(63) Continuation of application No. 12/568,252, filed on Sep. 28, 2009, now Pat. No. 8,146,204.

(60) Provisional application No. 61/102,088, filed on Oct. 2, 2008.

(51) Int. Cl.
*E05F 1/00* (2006.01)

(52) U.S. Cl. ..... 16/197; 49/181; 16/193

(58) Field of Classification Search ..... 16/197, 16/193, 400, 401, DIG. 16; 49/181, 445–447, 49/174–176

See application file for complete search history.

(56) References Cited

U.S. PATENT DOCUMENTS

| | | | |
|---|---|---|---|
| 1,864,745 | A | 6/1932 | Larson |
| 2,598,560 | A | 5/1952 | Kenyon |
| 2,604,655 | A | 7/1952 | Peremi |
| 2,622,267 | A | 12/1952 | Peremi |
| 2,776,447 | A | 1/1957 | Addicks |
| 2,780,457 | A | 2/1957 | Larson |
| 2,825,088 | A | 3/1958 | Decker et al. |
| 2,851,721 | A | 9/1958 | Decker et al. |
| 2,890,480 | A | 6/1959 | Gregg et al. |
| 3,478,384 | A | 11/1969 | Skolnik |
| 4,577,766 | A | 3/1986 | Miller |
| 5,152,032 | A | 10/1992 | Davis et al. |
| 5,267,416 | A | 12/1993 | Davis |
| 5,383,303 | A | 1/1995 | Nakanishi et al. |
| 6,263,541 | B1 | 7/2001 | Scates |
| 6,948,215 | B2 | 9/2005 | Malek et al. |

FOREIGN PATENT DOCUMENTS

EP 1696094 8/2006

*Primary Examiner* — Chuck Y. Mah

(74) *Attorney, Agent, or Firm* — Harness, Dickey & Pierce, P.L.C.

(57) ABSTRACT

A method and apparatus for reducing the torque of a compound balance in order to substantially cancel out the torsional force of the torsion spring acting on the spiral rod by creating an equal and opposing torsional force on the extension spring. The apparatus is an assembly connector that is non-permanently engaged with the extension spring, with the spiral rod being tensioned by the torsional force of the torsion spring. Alternatively, the extension spring may be turned in a direction to apply more torque than is required for operation of the compound balance. It is then engaged with a non pre-tensioned spiral rod sub-assembly to transfer the excess torque to the torsion spring of the spiral rod sub-assembly. In this manner, the opposing torsional forces of the torsion spring and the extension spring acting on the spiral rod substantially cancel out each other.

9 Claims, 15 Drawing Sheets

APPARATUS AND METHOD FOR CANCELING OPPOSING TORSIONAL FORCES IN A COMPOUND BALANCE

CROSS-REFERENCE TO RELATED APPLICATIONS

This application is a continuation of U.S. patent application Ser. No. 12/568,252 filed Sep. 28, 2009, now U.S. Pat. No. 8,146,204 issued Apr. 3, 2012, which is a non-provisional application of U.S. provisional application No. 61/102,088 filed Oct. 2, 2008. The entire disclosure(s) of (each of) the above application(s) is (are) incorporated herein by reference.

FIELD

The invention pertains to the field of compound window balances. More particularly, the invention pertains to a device and method for connecting the extension spring of a compound balance to the torsion spring/spiral rod sub-assembly.

BACKGROUND

Vertically sliding window assemblies are also known as hung windows and may consist of either a single sash or two sashes, respectively referred to as single hung or double hung windows. A hung window assembly generally includes a window frame, at least one sash, a pair of opposing window jambs, each jamb having a channel for allowing the vertical travel of each sash, and at least one window balance to assist with the raising and lowering of the sash to which it is attached by providing a force to counterbalance the weight of the sash.

Springs are utilized to provide the counterbalancing force and are especially useful for operating very heavy sashes. Compound balances are preferred for facilitating the operation of these very heavy sashes. In compound balances, a torsion spring provides a lifting force over the full travel of the sash through the jamb channel. The torsion spring force is converted into a lifting force by extending an elongated spiral rod. The torsion spring and elongated spiral rod are surrounded by an extension spring. Alternative designs have the sub-assembly encapsulated within a containment tube. It is desirable to have the combined axial forces of the torsion spring of the sub-assembly and extension spring provide substantially constant lifting force over the full vertical travel of the compound balance. The compound balance has an open end, from which the free end of the spiral rod extends, and a closed end, which is securely fastened to the wall of the jamb channel of the window frame.

The open end of the compound balance sub-assembly is often capped by a rotatable coupling having a central opening through which the elongated spiral rod extends. When the free end of the spiral rod is attached to a window sash, depending on the direction of vertical movement required to open the window, the spiral rod is either substantially fully extended or substantially fully retracted into the balance. In a double hung window design, the upper sash moves in a downward direction to open that portion of the window while the lower sash moves upwardly to open that respective portion of the window.

In tilting window sashes, the free end of the spiral rod connects to a shoe or carrier which traverses up and down the jamb channel of the window assembly with the sash. The window sash and window balance are linked together via a shoe or carrier.

Alternatively, the free end of the spiral rod may attach directly to the sash itself. In this case, a clip is securely attached to the end of the spiral rod. The conventional means of attaching the clip to the spiral rod includes the use of a rivet or an interference fit clip.

Especially with respect to windows having large, very heavy sashes, it is highly desirable to design a balance that provides the most lifting assistance. If the torsion spring exhibits too much torsional force, then the window operator must overcome the surplus frictional force caused by the torsional forces upon the carrier moving through the jamb channel. It is very desirable therefore to eliminate or substantially limit the amount of torque transferred from the compound balance to the connecting hardware. A reduction in the transfer of this torque lowers the lifting force required and therefore facilitates the raising and/or lowering of the sash.

SUMMARY

An apparatus and method substantially canceling out the torsional force exerted on the spiral rod by the torsion spring so that the force on the spiral rod of a compound balance is substantially in a state of equilibrium and exhibits either no or very limited torque which would otherwise result in added frictional forces that increases the amount of energy needed to raise and lower the sash. In embodiments of the present invention, an extension spring, co-axial with and surrounding the spiral rod sub-assembly, is wound a number of turns to create a torque that opposes the torque imposed on the spiral rod by the torsion spring. The extension spring is preferably attached to the spiral rod either by an assembly connector attached to the end of the extension spring or a multi-angled series of bends in proximity to the end of the extension spring which provides for its attachment to the spiral rod by a pin or small rod. With the extension spring secured to the spiral rod, the extension spring is prohibited from unwinding when torque from the torsion spring of the spiral rod sub-assembly is applied. The attachment means functions to maintain the torsional force provided by the extension spring. This cancels out the torsional force of the torsion spring acting on the spiral rod with the opposing torsional force of the extension spring.

DRAWINGS

DETAILED DESCRIPTION

Figure 1A:
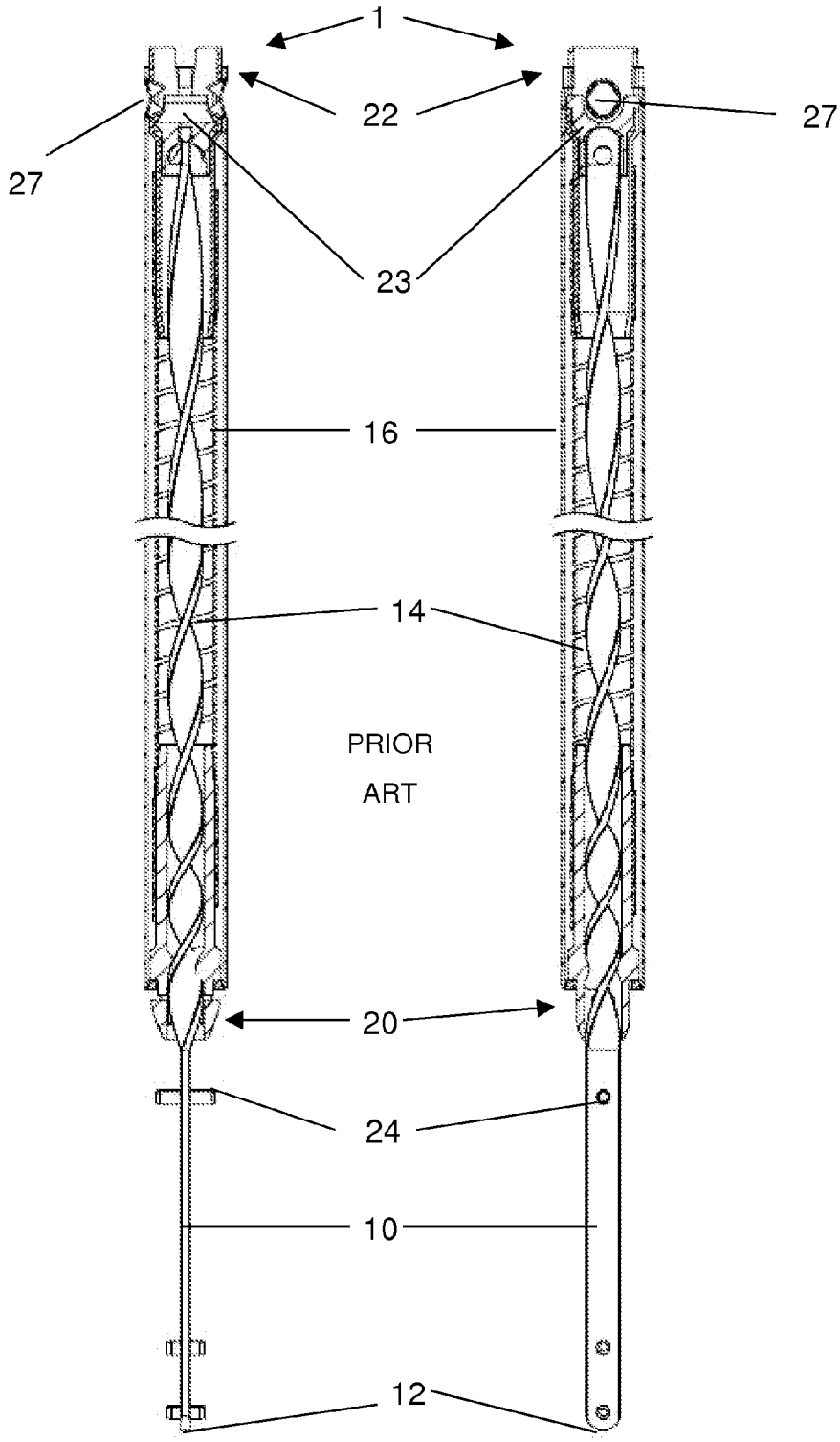
FIG. 1A shows two cross-sectional views of a conventional compound balance inner sub-assembly, each view 90 degrees opposed from the other.

Referring to FIG. 1A, the inner sub-assembly of a conventional compound window (or sash) balance is shown in 90° opposed views. The combination of the spiral rod 10 and the torsion spring 14 are conventionally referred to as the "inner" sub-assembly 1. It includes at least a spiral rod 10 having a first end 12 that extends from a first end 20 of the inner sub-assembly 1. The spiral rod 10 is secured to a spiral shaped torsion spring 14 within the inner sub-assembly 1. The torsion spring 14 may be either encapsulated by an optional containment tube 16 or it may remain non-encapsulated. FIG. 1A shows the sub-assembly encapsulated by a containment tube 16. Nonetheless, whether a containment tube 16 is present or not, an extension spring 18 encapsulates either the containment tube 16, if present, or the torsion spring 14 (see FIG. 1B) to form a compound balance 2. In the present invention, the direction of the turns applied to the torsion spring 14 and the extension spring 18 are preferably opposite each other in order to provide the balance manufacturer with the ability to cancel out opposing torsional forces acting on the spiral rod 10. The more these opposing forces are canceled out, the less friction exists within the window system and the more lifting assistance is provided to the help the operator move the sash (not shown) either up or down. In conventional compound balances, there are no (counter torque) turns applied to the extension spring 18 to create an opposite torsional force that substantially cancels out the opposing torsional force of the torsion spring acting on the spiral rod 10.

Figure 1B:
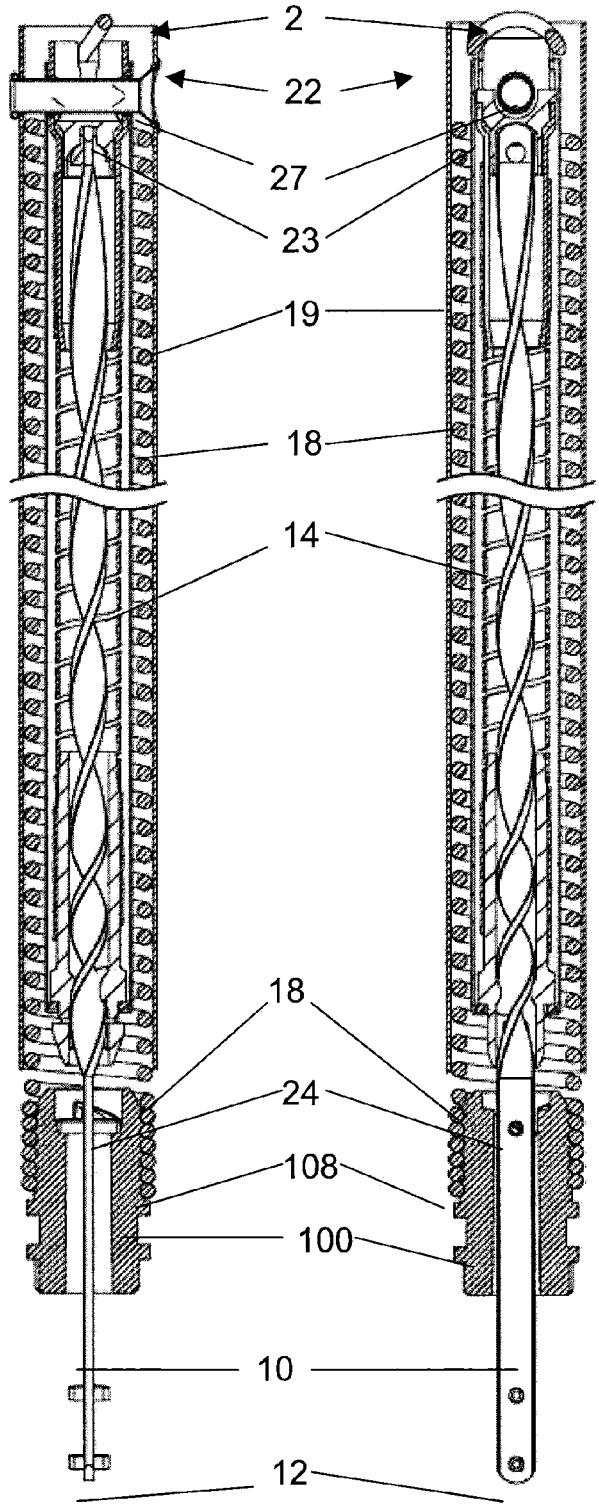
FIG. 1B shows two cross-sectional views of the compound balance of the present disclosure where the extension spring encapsulates the inner sub-assembly.

The first end 12 of the inner sub-assembly 1 extends out of the first end 20 of the compound balance 2. The second end 22 of the inner sub-assembly 1 is non-permanently secured to an internal anchoring means 23, as shown in FIGS. 1A and 1B. The second end 22 of the compound balance 2 is firmly secured to a wall of the jamb channel (not shown) by means of a screw, rivet or locking pin inserted through hole 27. At the first end 12 of the inner sub-assembly 1 is extended, the torsional force of the torsion spring 14 is transferred to the spiral rod 10. Although the torsional force is intended to provide a progressively increasing axial force along the axis of the balance and the jamb channel of the window frame to retract the spiral rod 10 into the inner sub-assembly, thereby assisting the operator with the vertical movement of the sash, this torsional force also creates substantial friction, especially at the interface between the carrier to which the spiral rod is attached and the jamb channel of the window frame. This is counterproductive with respect to the goal of achieving easy movement of the sash.

In some embodiments of the present disclosure, an assembly connector 100, as shown in several variations in FIG. 2A through FIG. 7, transfers the torsional force of the extension spring to the sprial rod. The assembly connector substantially alleviates the undesired transfer of the torsionally induced friction from the torsion spring of the inner sub-assembly 1 to other components of the window assembly.

Figure 2A:
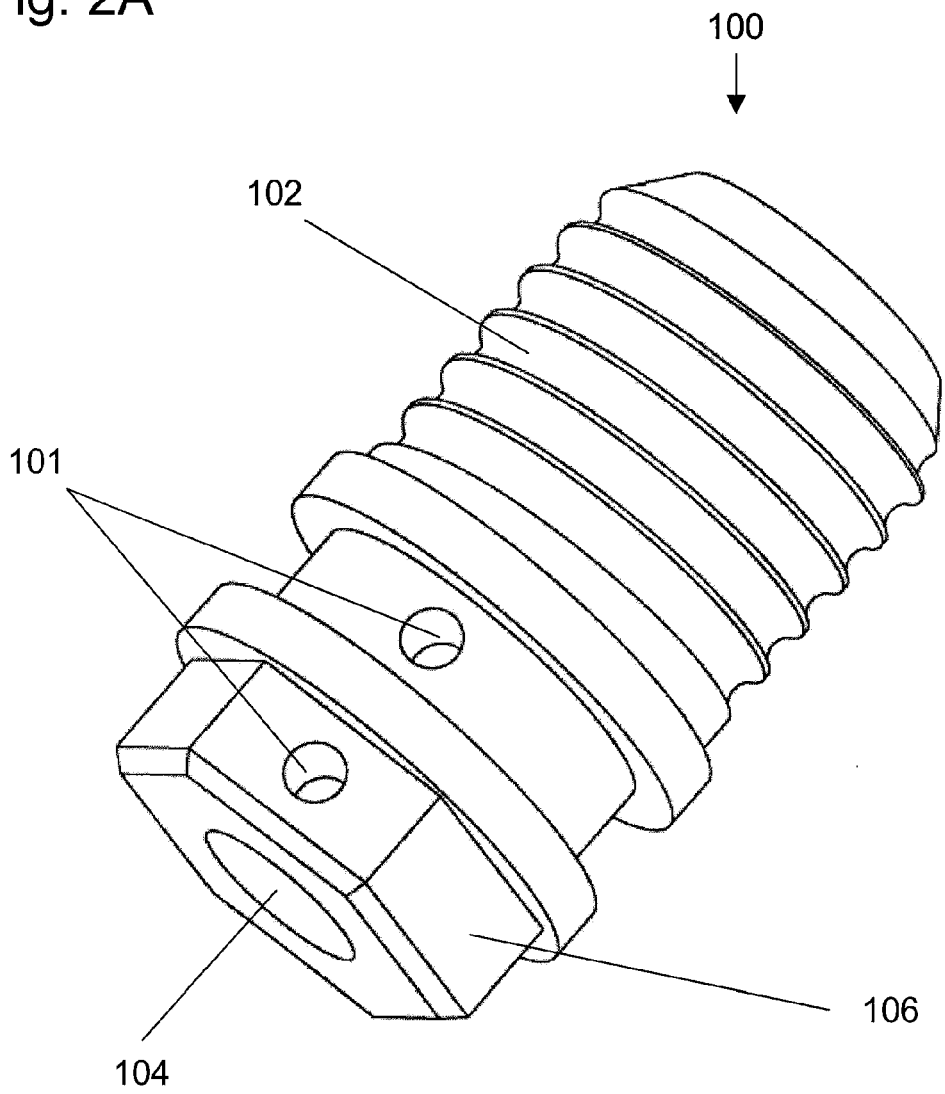
FIG. 2A shows an isometric view of an assembly connector in an embodiment of the present disclosure.

These counterproductive torsionally induced frictional forces are substantially eliminated by use of the assembly connector 100 (FIG. 2A-FIG. 7). FIG. 2A shows an isometric view of the assembly connector 100. It includes an extension spring attachment portion 102, a bore 104 through which the first end 12 of the spiral rod 10 extends, a hole 101 through which a spiral rod pin 24 (see FIGS. 1A and 1B) may be inserted, and an adjustment portion 106. In FIGS. 2A, 5, 6 and 7, the adjustment portion 106 is shown as being hexagonally shaped. However, any suitable geometric configuration may be used so long as it achieves the desired objective which is to provide a means to rotate or hold the assembly connector 100 while the extension spring 18 is being rotated. The unattached or first end 108 of the extension spring 18 is spun onto the threads of the extension spring attachment portion 102, which can be designed to accommodate either a right or left hand turned extension spring.

In a method of assembling the first embodiment of the present invention, the spiral rod 10 is rotated, which creates a torsional force maintained by the torsion spring 14. Then, the spiral rod 10 is allowed to retract into the inner sub-assembly 1 to be seated within the internal anchoring means 23 (FIGS. 1A and 1B) to prevent further rotation until the spiral rod 10 is extended during use. Next, a counter torque is applied to the extension spring 18 by turning it in a direction opposite from the direction of the turns applied to the spiral rod of the inner sub-assembly 1. In one variation, the assembly connector 100 is attached to the extension spring 18 and the turns are then applied to the assembly connector 100. In another variation, the turns on the extension spring 18 may be applied prior to engagement with the assembly connector 100. The preferred means of attachment is by first securing the extension spring 18 onto the extension spring attachment portion 102 of the assembly connector 100. This is preferably performed by turning or "screwing" the first end 108 of the extension spring 18 onto threads formed on the exterior of the extension spring attachment portion 102 (see FIG. 4A).

Figure 2B:
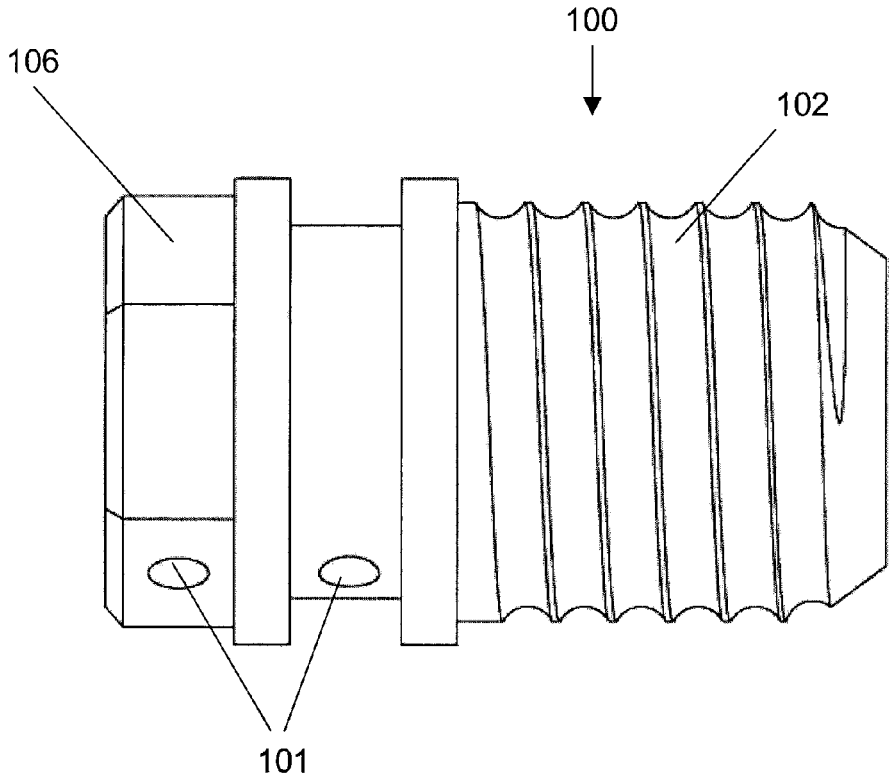
FIG. 2B shows a side plan view of the assembly connector of FIG. 2A.
Figure 2C:
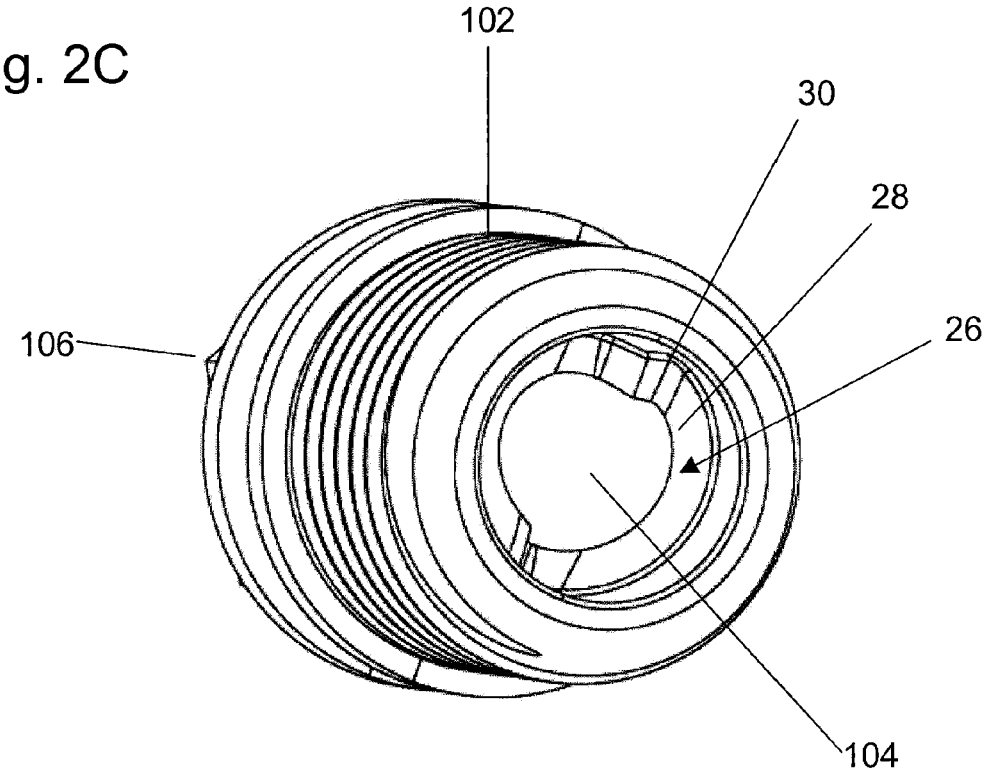
FIG. 2C shows an isometric view of the assembly connector of FIG. 2! having internally configured ramp elements for interaction with locking elements on the spiral rod.
Figure 2D:
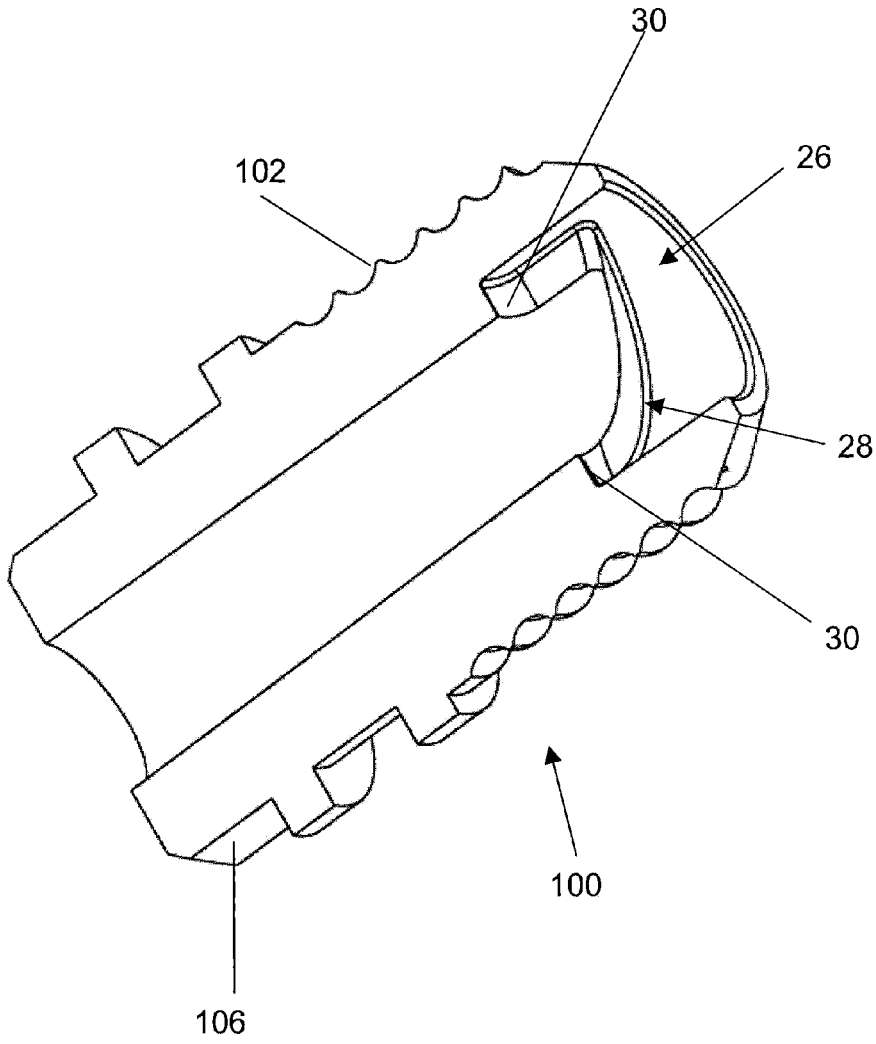
FIG. 2D shows a cross-sectional view of the assembly connector of FIG. 2A showing approximately one half of the segments of the internally configured ramp elements.

Another method of assembling the compound balance of the invention involves rotating the extension spring attachment portion 102 of the assembly connector 100 axially in a direction that is opposite from the pretension rotations applied to torsion spring 14. The spiral rod pin 24 (FIGS. 4B, 5 and 6) is then inserted through hole 101 in the assembly connector 100 to maintain the torque applied to the extension spring 18. FIGS. 2A and 2B show two locations for hole 101. However, these images are provided to show alternate locations for this hole. Only one hole 101 is necessary to receive spiral rod pin 24.

As noted earlier, a compound balance of the invention can be assembled with a non-pretensioned inner sub-assembly. In this case, the extension spring is turned to contain more torque than would be needed under normal operating conditions so that when the connector 100 is secured to the rod 10 by insertion of spiral rod pin 24 and the rod is disengaged from the pretension anchor 23, the spiral rod 10 rotates, thereby winding the torsion spring 14 in an opposite direction from the turns applied to the extension spring 18 to a point where the torsional forces between the torsion spring 14 and the extension spring 18 substantially cancel out each other. In this manner, the excess torque of the extension spring 18 is transferred to the inner subassembly 1, winding the torsion spring 14 until the opposing torsional forces of the extension spring and the torsion spring substantially cancel out the undesired torsional force acting on the spiral rod 10.

Another method of assembling the compound balance involves rotating the extension spring attachment portion 102 of the assembly connector 100 axially in a direction that is opposite from the pretension rotations already applied to the spiral rod 10. The assembly connector 100 is seated against the pin retaining portion 26 (see FIGS. 2C and 2D) via spiral rod pin 24. The pin retaining portion 26, best shown in FIGS. 2C and 2D, includes two diametrically opposed hemi-spherically shaped ramps 28 that guide the spiral rod pin 24 to a seat portion 30. Once the spiral rod pin 24 of the spiral rod 10 is secured within seat portion 30, the torque applied to the extension spring 18 is maintained. If assembled properly, the pretension torque applied to the torsion spring 14 (by turning the spiral rod 10) is cancelled out by the torsional forces applied to the extension spring 18. If further adjustment is necessary, due to the ease of moving the spiral rod pin along ramps 28, the assembly connector 100 may be further turned until the opposing torsional forces between the torsion spring 14 of the inner sub-assembly 1 and that of the extension spring 18 are substantially cancelled out.

Figure 3:
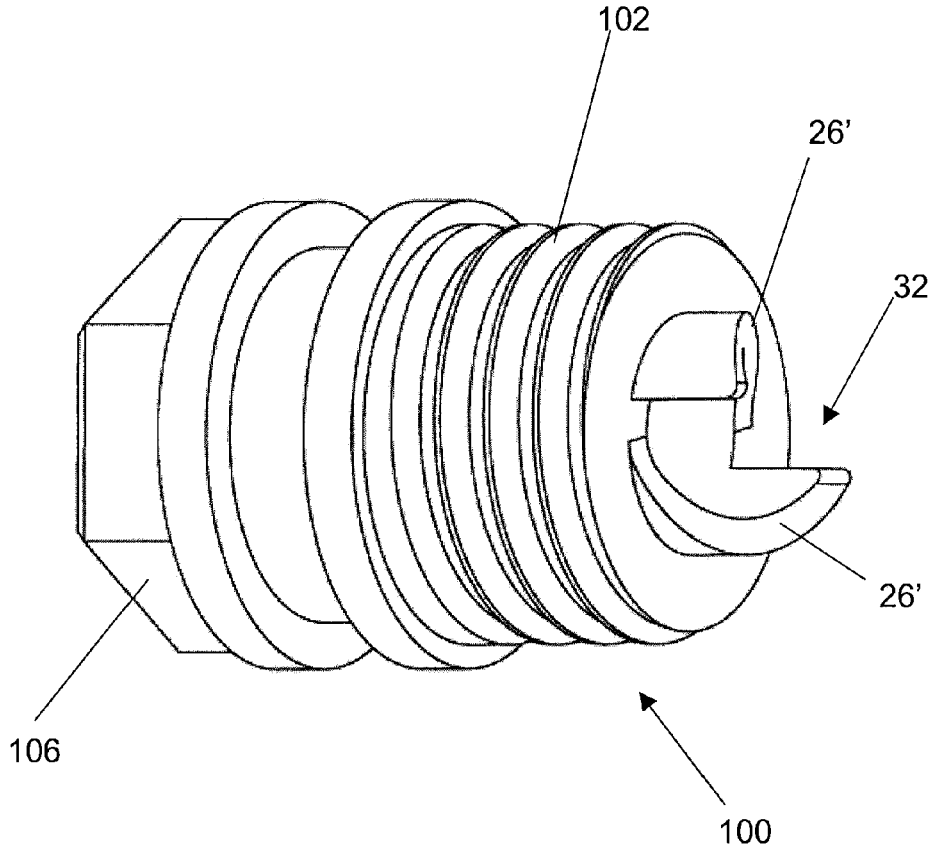
FIG. 3 shows an isometric view of an assembly connector having externally configured ramp elements.
Figure 4A:
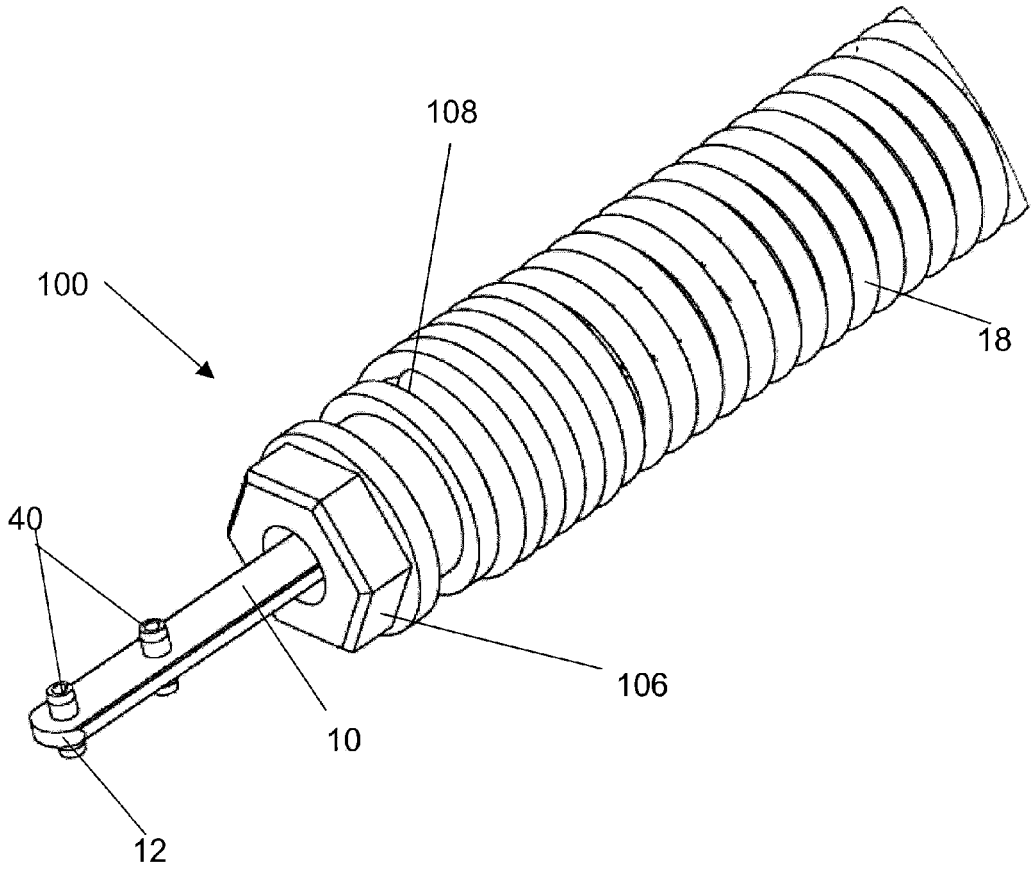
FIG. 4A shows an assembly connector, the spiral rod and the extension spring secured to the assembly connector.
Figure 4B:
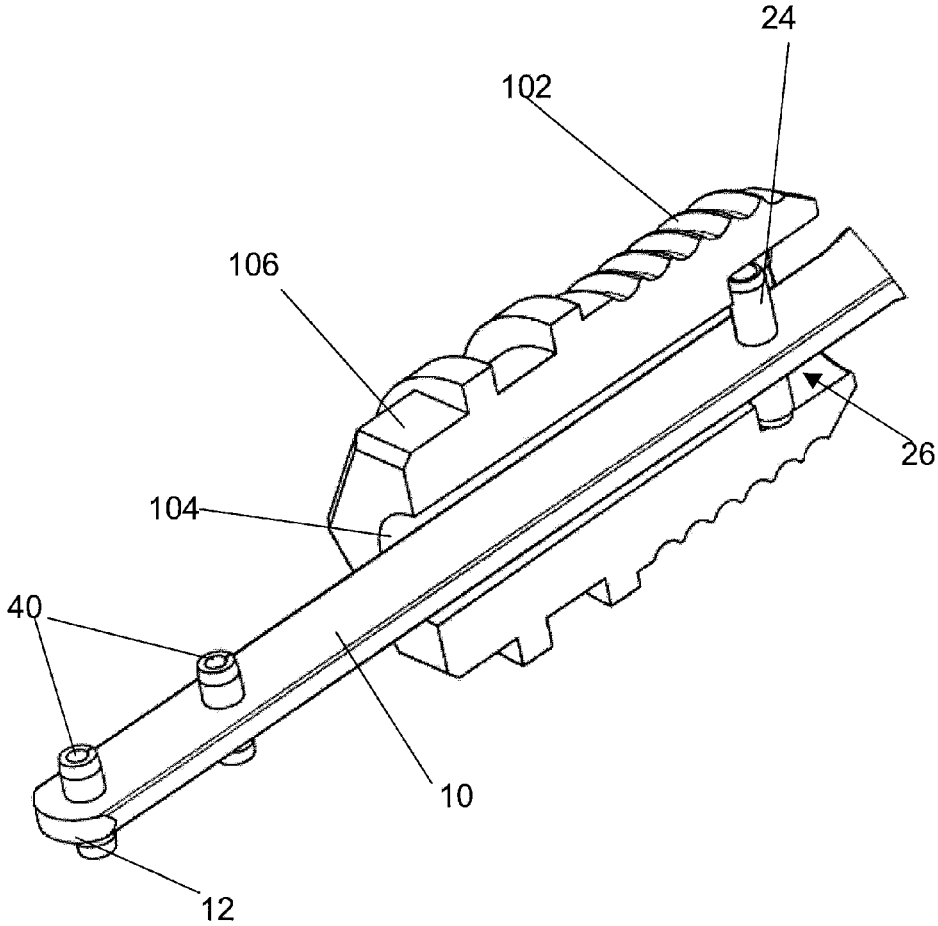
FIG. 4B shows a cross-section of the assembly connector of FIG. 4A with elements of the spiral rod engaging the internally configured ramp elements of the assembly connector.

A first variation of the assembly connector 100 is shown in FIG. 3. The primary difference between the embodiment shown in FIGS. 2A-2D and that shown in FIG. 3 is that the variation of FIG. 3 shows the ramped pin retaining portion 26' being located external to the main body of the assembly connector 100. The spiral rod pin 24 is retained against seat portion 32. Otherwise, the external ramped pin retaining portion 26' embodiment of FIG. 3 operates essentially the same as does the internal pin retaining portion 26 of the embodiment shown in FIGS. 2C and 2D.

Figure 5:
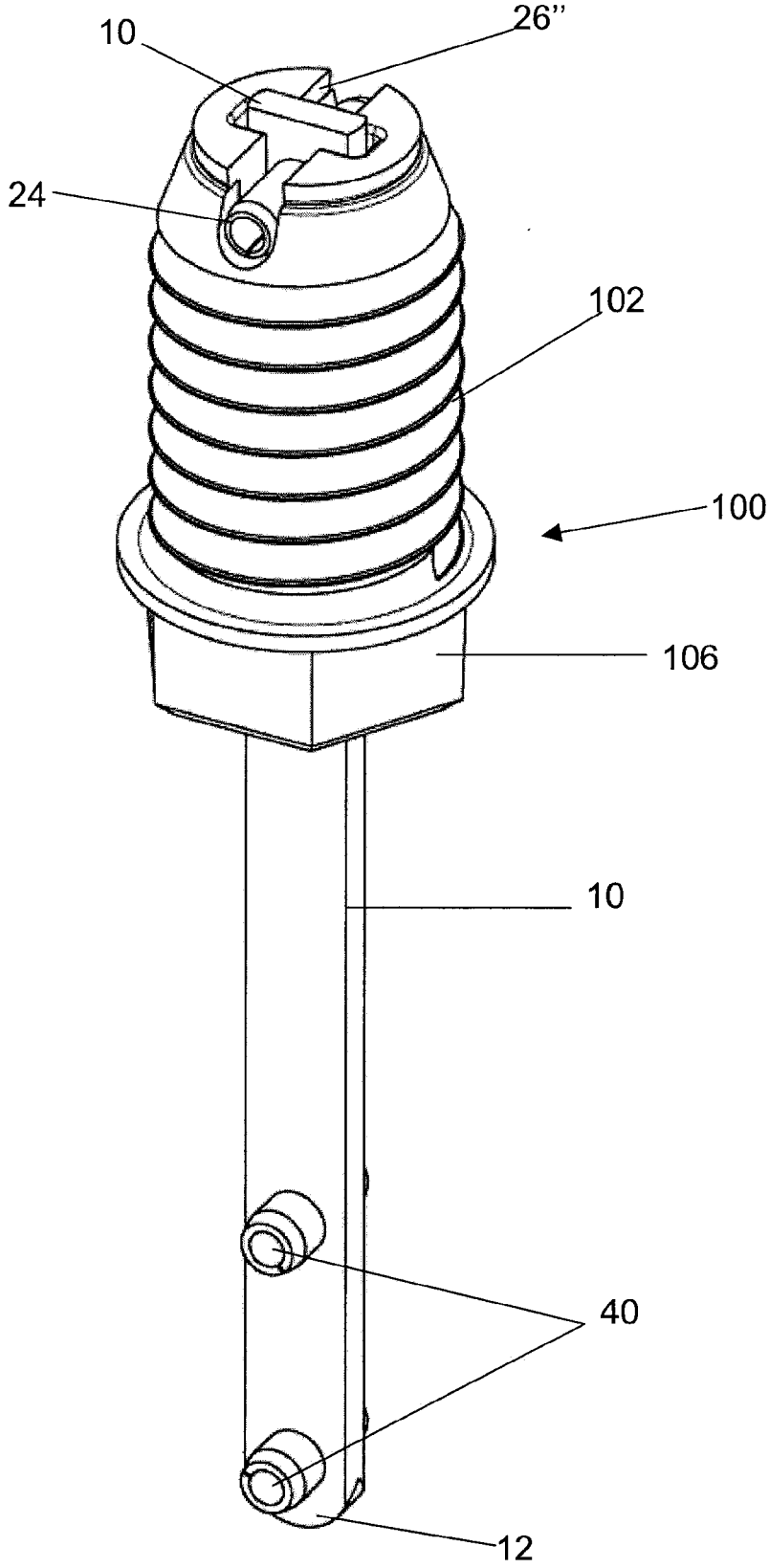
FIG. 5 shows an isometric view of an assembly connector with a lock.
Figure 6:
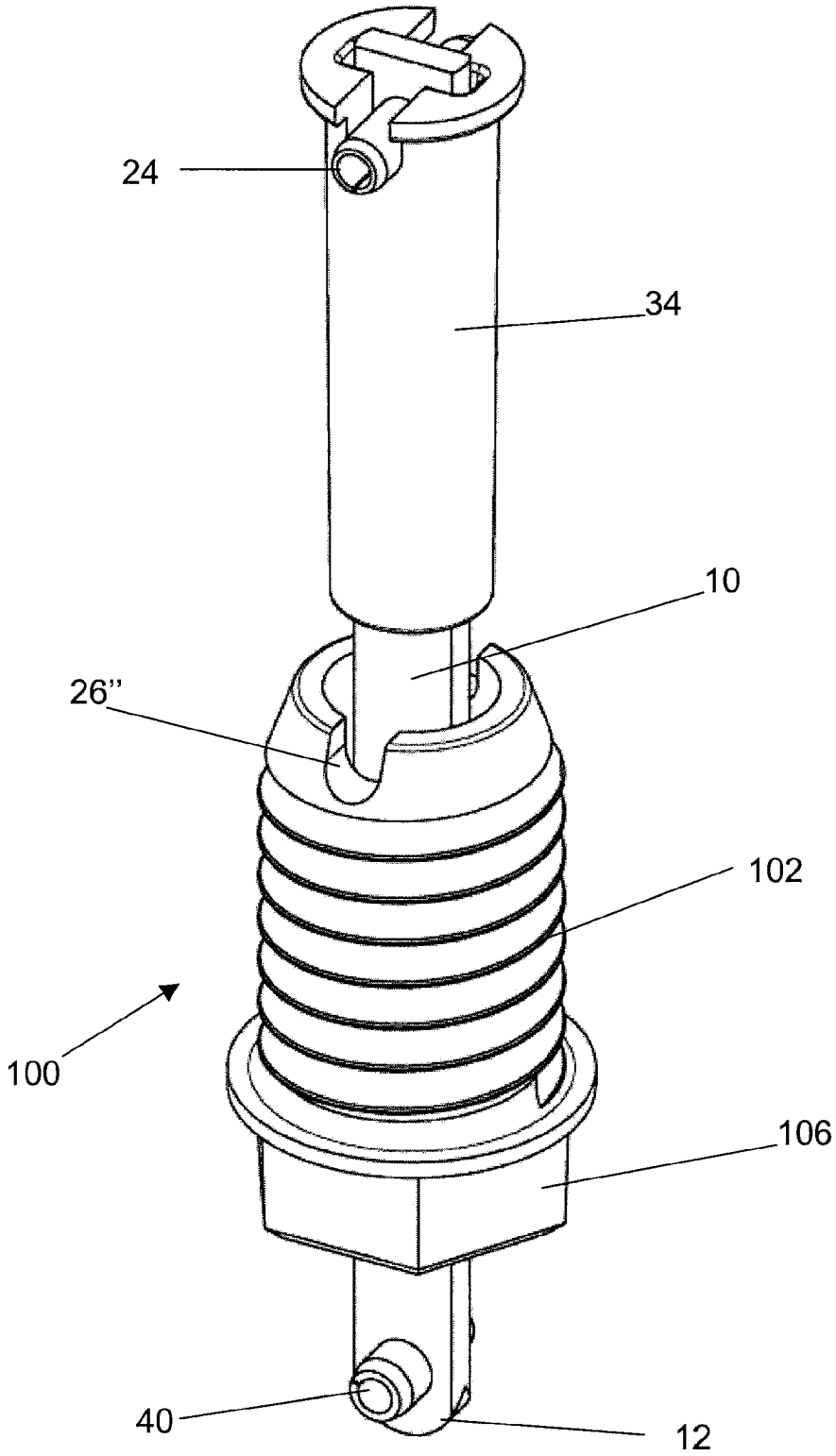
FIG. 6 shows an isometric view of the assembly connector of FIG. 5 separated from a progressively tapered internal sleeve located within the assembly connector.

A second variation of the assembly connector 100 is shown in FIGS. 5 and 6. In this variation, a sleeve 34 is non-permanently interference fitted between the spiral rod 10 and the assembly connector 100. Referring specifically to FIG. 6, the outer diameter of the sleeve 34 is tapered so that the outer diameter gradually decreases as it approaches the end 12 of the spiral rod 10. The distal end (opposite the adjustment portion 106) of the assembly connector 100 contains at least one "paired" diametrically opposed "U" shaped notches 26". The preferred number of "U" shaped notches is two, which, of course would engage only one spiral rod pin 24. The increasing outer diameter of the sleeve 34 provides for a progressively increasing interference fit between the sleeve 34 and the inner diameter of the assembly connector 100. The assembly connector 100 of this variation permits the non-permanent engagement between "U" shaped notches 26" and the spiral rod pin 24 to maintain substantial equilibrium between the respective torsional forces of the torsion spring 14 and the extension spring 18.

Figure 7:
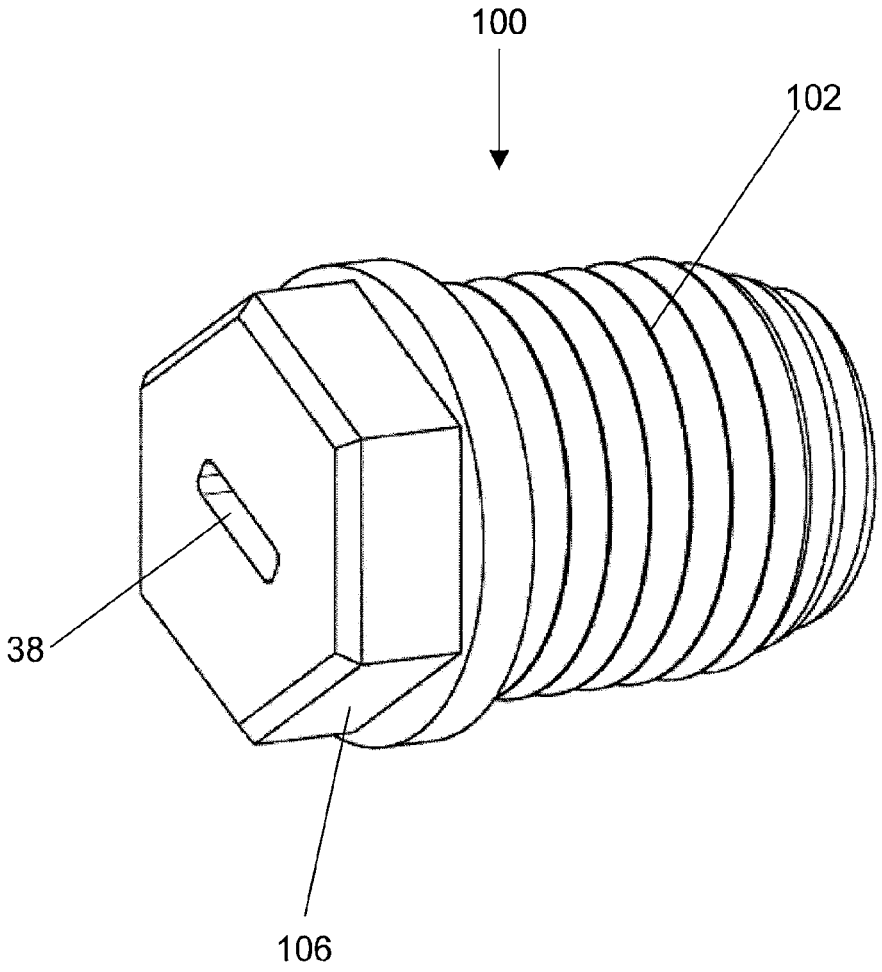
FIG. 7 shows an isometric view of the assembly connector in which a slot rather than a round hole provides the opening through which the end of the spiral rod extends.

A slight modification of the assembly connector 100 of FIGS. 2A-2D is shown in FIG. 7. Referring back to FIG. 5, this embodiment of the assembly connector 100 exhibits a circular hole that allows for the easy passage therethrough of a spiral rod 10 containing rod pins 40. These rod pins 40 are used for engagement with a hook or similar device for attachment to an edge of the window sash. FIG. 7 shows a bore slot 38 designed to accommodate the size of the spiral rod 10 only. During assembly, the counter torque is first applied to the extension spring 18 and then the bore slot 38 of the assembly connector 100 is aligned with the spiral rod 10. The assembly connector 100 is then allowed to slip over the spiral rod 10. Of course, rod pins 40 must be installed onto the spiral rod 10 after the assembly connector 100 is installed onto the compound balance 2 because they will not fit through the bore slot 38. Once all elements of the compound balance 2 are returned to their resting states, the torsional forces between the torsion spring 14 and the extension spring 18 substantially cancel out each other.

Figure 8:
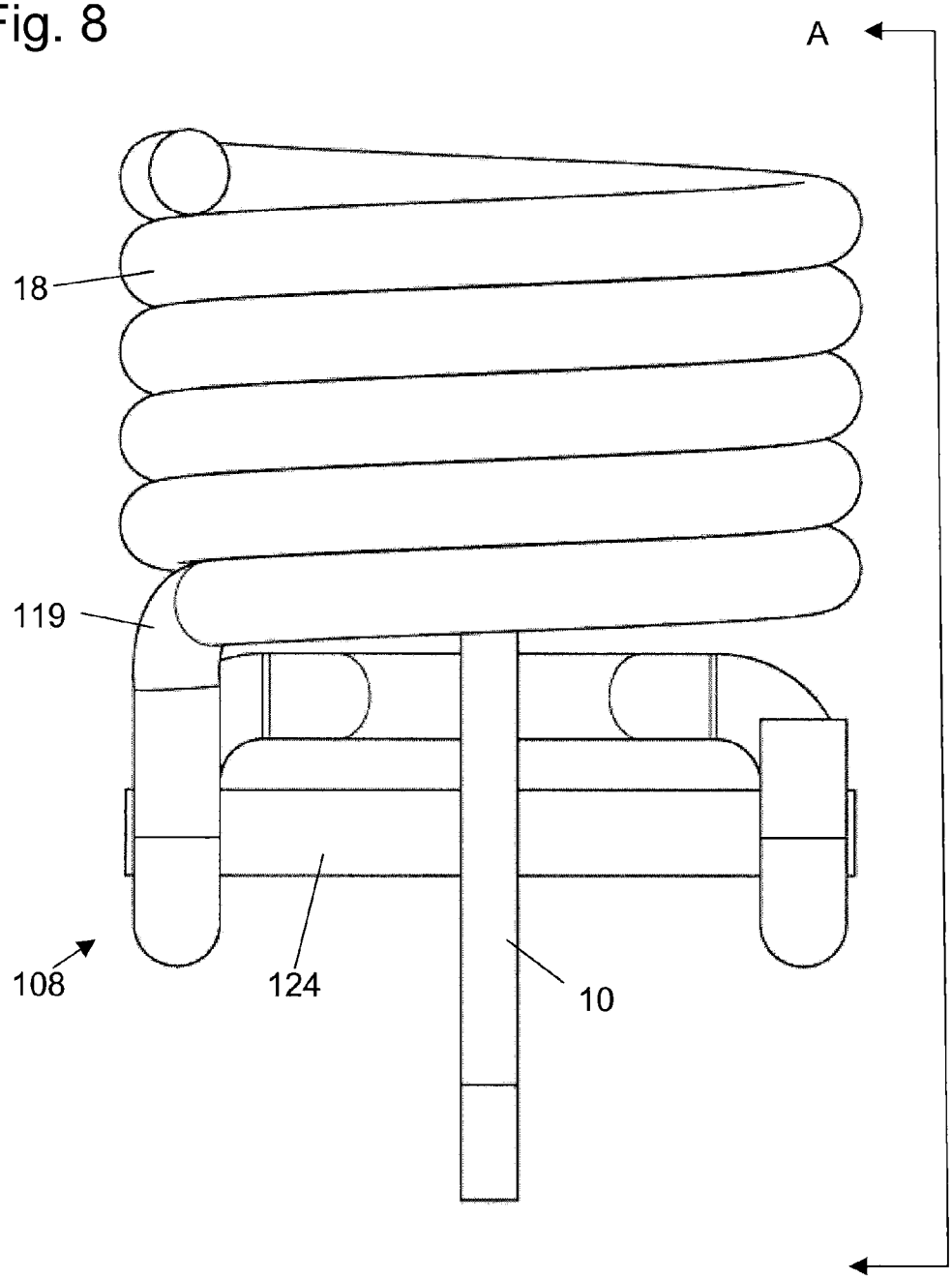
FIG. 8 shows a plan view of an assembly connector in which the end of the extension spring is configured to interact with a pin or small rod to connect the extension spring to the spiral rod.
Figure 9:
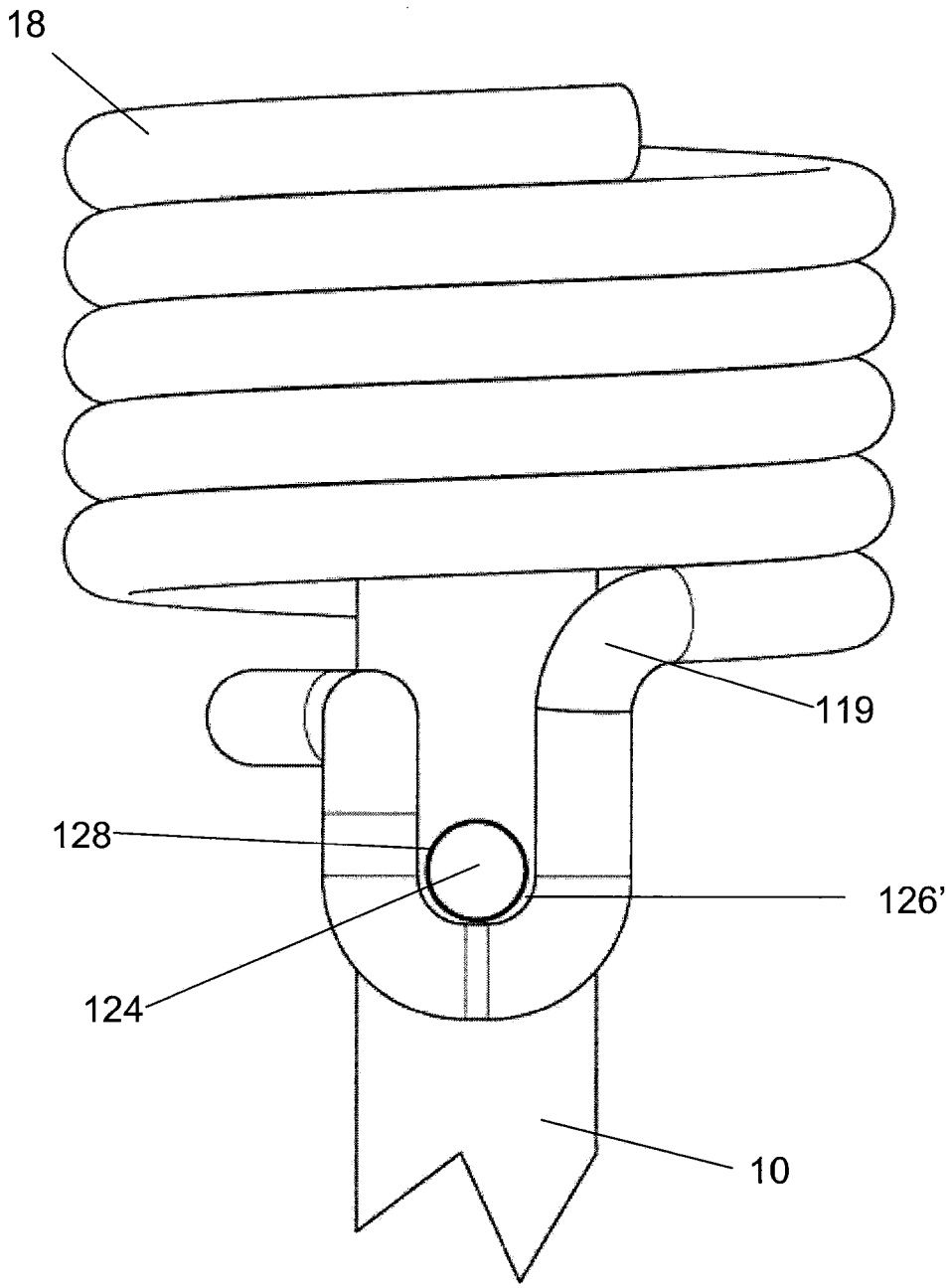
FIG. 9 shows a plan view of the assembly connector of FIG. 8 as viewed along line A-A of FIG. 8.
Figure 10:
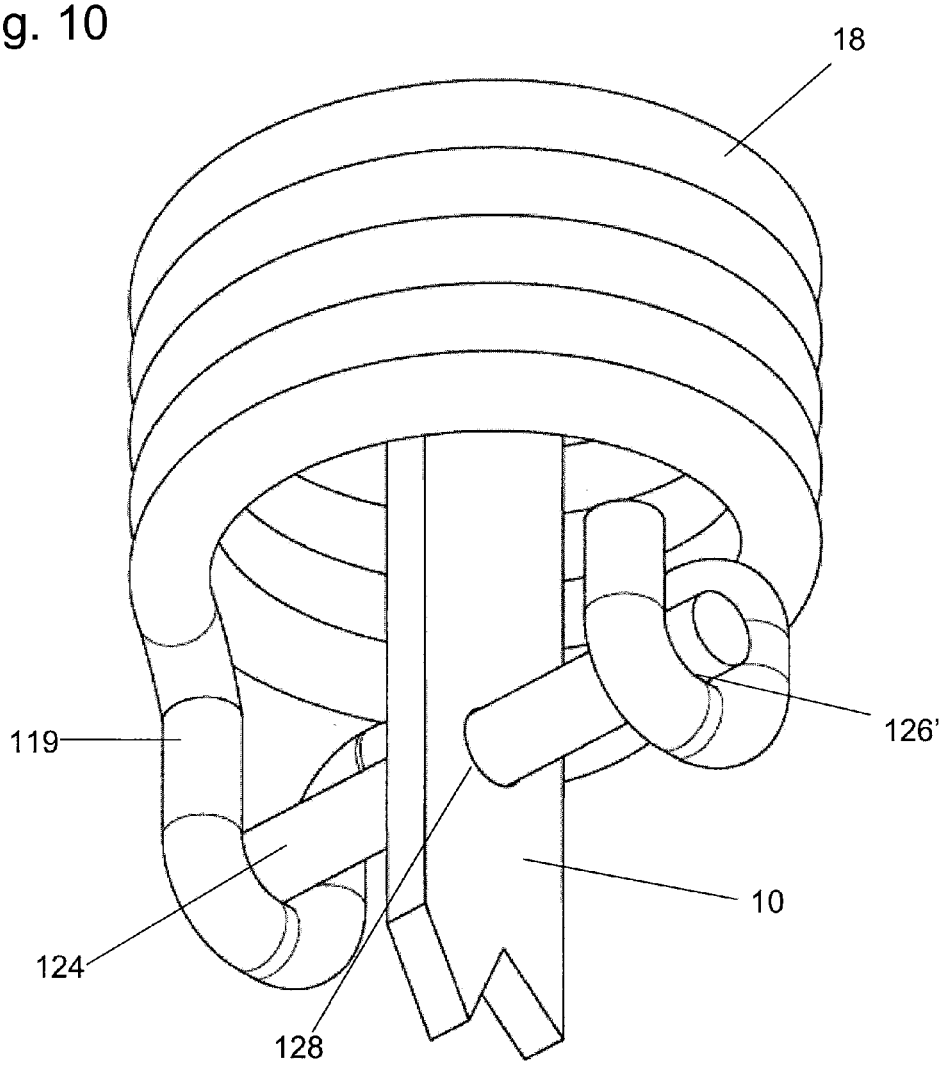
FIG. 10 shows an isometric view of the assembly connector of FIG. 8.

A second embodiment of the attachment means of the invention is shown in FIGS. 8, 9 and 10. It includes of configuring the final windings 119, which are located at the first end 108 of extension spring 18, so as to create two "U" shaped seats, a first seat 126 and a second seat 126' (FIG. 10). These two seats are designed to retain a pin 124 that is secured to spiral rod 10. When the torsional forces between the torsion spring (not shown in these Figures) and the extension spring 18 substantially cancel out each other, the pin 124 is inserted through a hole 128 in proximity to the first end 12 of the spiral rod 10 and the pin is then urged into the "U" shaped seats 126 and 126'. The pin 124 maintains continuity between the torsional forces of the torsion spring (via the spiral rod 10) and the torsional forces of the extension spring 18. Now that the torsional forces of the torsion spring and the extension spring have substantially canceled out each other, the compound balance 2 may be installed into the jamb channel of a window frame.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A compound balance for a window sash comprising:

a torsion spring having a fixed end and a free end, wherein the torsion spring is biased in a first rotational direction such that the torsion spring generates a torque in an opposite second rotational direction;

a spiral rod coupled to the torsion spring at the free end of the torsion spring and comprising means for engaging the window sash;

an extension spring disposed co-axially with and over the torsion spring and the spiral rod, the extension spring having a fixed end and a free end, wherein the extension spring is biased in the second rotational direction such that the extension spring generates a torque in the first rotational direction; and means for coupling the spiral rod to the extension spring at the free end of the extension spring.

2. The compound balance of claim 1 wherein the means for coupling comprises a pair of opposed seats formed in a winding at the free end of the extension spring and a connecting member passing through the spiral rod and having opposite ends retained in the opposed seats.

3. The compound balance of claim 2 wherein each of the opposed seats is "U" shaped.

4. A compound balance for a window sash comprising:

a torsion spring having a fixed end and a free end, wherein the torsion spring is biased in a first rotational direction such that the torsion spring generates a torque in an opposite second rotational direction;

a spiral rod coupled to the torsion spring at the free end of the torsion spring and comprising one or more first pins through which the compound balance engages the window sash;

an extension spring disposed co-axially with and over the torsion spring and the spiral rod, the extension spring having a fixed end and a free end, wherein the extension spring is biased in the second rotational direction such that the extension spring generates a torque in the first rotational direction;

an attachment member coupling the spiral rod to the extension spring; and wherein the extension spring comprises a retaining portion adapted to receive the attachment member.

5. The compound balance of claim 4 wherein the retaining portion comprises a plurality of opposed "U" shaped seats formed in a winding at the free end of the extension spring.

6. The compound balance of claim 5 wherein the attachment member comprises a second pin.

7. A method for assembling a compound balance having an operating load range, the balance comprising a torsion spring coupled to a spiral rod extending along a longitudinal axis, the torsion spring operable to produce a torque generally perpendicular to the longitudinal axis and in a first direction, and an extension spring disposed co-axially with and over the torsion spring and spiral rod, the torsion spring and the extension spring each having a fixed end and a free end, the method comprising:

rotating the free end of the extension spring in the first direction about the longitudinal axis for a predetermined number of rotations to generate a torque in an opposite second direction; and coupling the spiral rod to the extension spring while the extension spring is torsionally biased.

8. The method of claim 7, wherein the step of rotating comprises rotating the free end of the extension spring in a first direction until a torque is generated in the second direction that is approximately twice the torque necessary to operate the balance within the operating load range.

9. The method of claim 7 further comprising, before the step of coupling, rotating the torsion spring in the second direction for a pre-determined number of rotations.

* * * * *